US005988256A

United States Patent [19]

Winters

[11] Patent Number: 5,988,256

[45] Date of Patent: Nov. 23, 1999

[54] AUTOMATIC GARAGE DOOR SCREEN

[76] Inventor: Bryan D. Winters, 23992 Bough Ave., Mission Viejo, Calif. 92691

[21] Appl. No.: 09/086,440

[22] Filed: May 28, 1998

[51] Int. Cl.[6] ..... E06B 9/70

[52] U.S. Cl. ..... 160/310; 160/116; 160/DIG. 18

[58] Field of Search ..... 160/310, 273.1, 160/271, 180, 116, 23.1, 41, DIG. 18

[56] References Cited

U.S. PATENT DOCUMENTS

| | | | |
|---|---|---|---|
| 4,335,773 | 6/1982 | Masi | 160/370.22 X |
| 4,478,268 | 10/1984 | Palmer | 160/310 |
| 4,673,019 | 6/1987 | Silverthorne et al. | 160/268.1 |
| 4,815,515 | 3/1989 | Lee | 160/23.1 |
| 4,846,241 | 7/1989 | Chomka et al. | 160/23.1 |
| 5,323,835 | 6/1994 | Bachmeier | 160/368.1 X |
| 5,358,025 | 10/1994 | Wood | 160/368.1 |
| 5,372,173 | 12/1994 | Horner | 160/310 X |
| 5,427,169 | 6/1995 | Saulters | 160/DIG. 18 X |
| 5,758,704 | 6/1998 | Elrod | 160/327 X |

*Primary Examiner*—David M. Purol

[57] ABSTRACT

A new automatic garage door screen for covering a garage door opening to let air through while still providing a barrier to insects and debris. The inventive device includes a flexible panel having a plurality of apertures therethrough extending between first and second surfaces of the panel. A storage housing mountable to the top of a garage door opening is also provided. An elongate roller is rotatably mounted in the interior of the storage housing with a motor included for rotating the roller. The top edge of the panel is coupled to the roller. A pair of elongate guide tracks are mountable to the sides of a garage door opening. Each guide track has an elongate side channel extending between the ends of the guide track. One of the side edges of the panel is inserted into the side channel of one of the guide tracks while the other side edge of the panel is inserted into the side channel of the other guide track.

11 Claims, 3 Drawing Sheets

FIG. 1
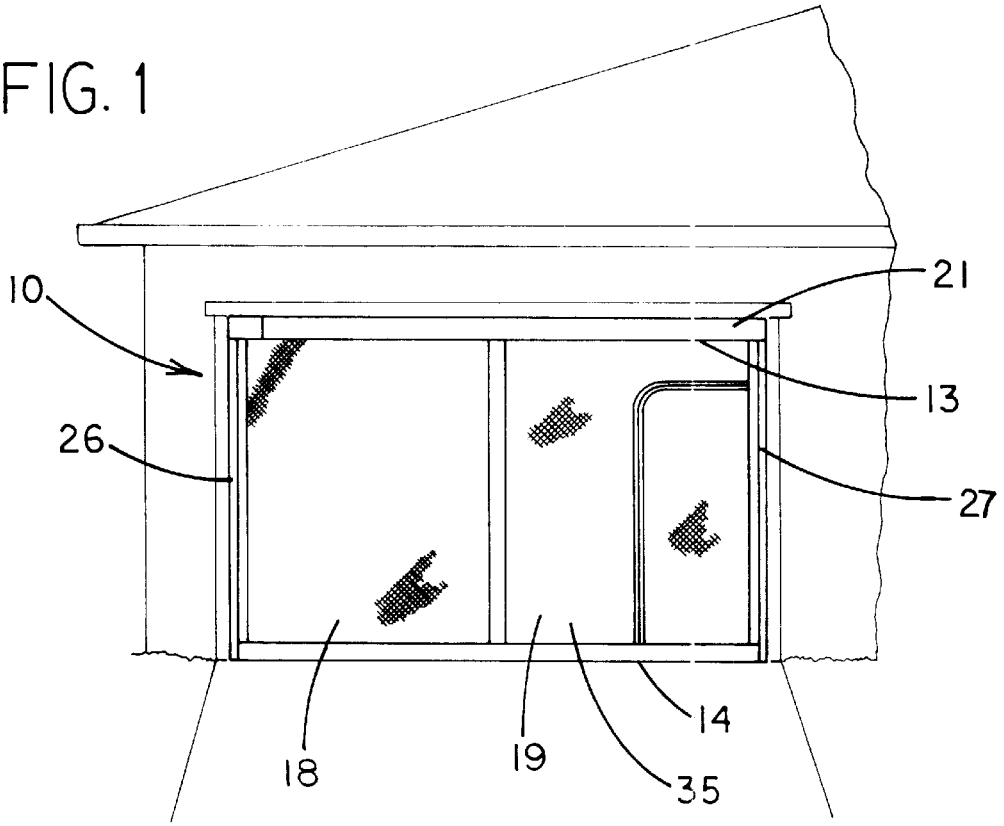
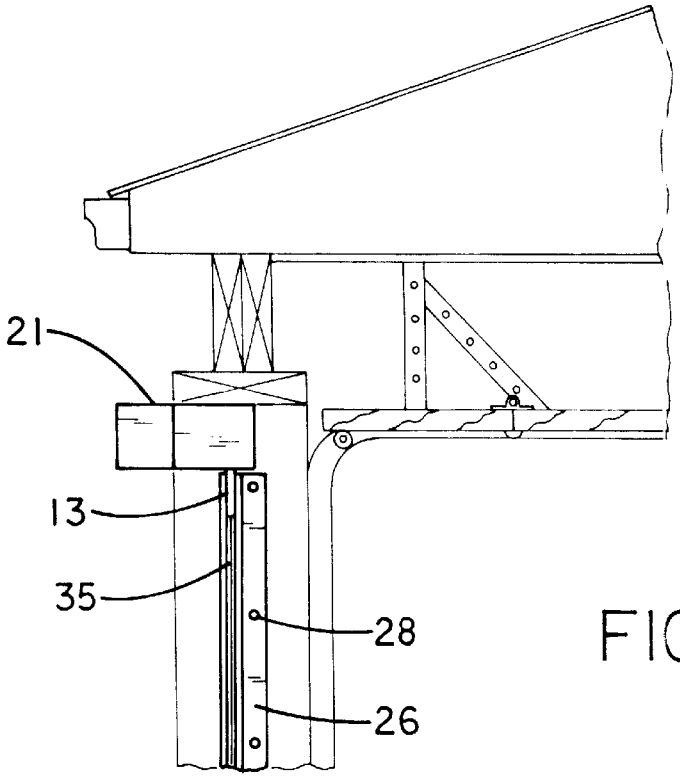
FIG. 2

AUTOMATIC GARAGE DOOR SCREEN

BACKGROUND OF THE INVENTION

1. Field of the Invention

The present invention relates to screen door devices for garage doors and more particularly pertains to a new automatic garage door screen for covering a garage door opening to let air through while still providing a barrier to insects and debris.

2. Description of the Prior Art

The use of screen door devices for garage doors is known in the prior art. More specifically, screen door devices for garage doors heretofore devised and utilized are known to consist basically of familiar, expected and obvious structural configurations, notwithstanding the myriad of designs encompassed by the crowded prior art which have been developed for the fulfillment of countless objectives and requirements.

Known prior art screen door devices for garage doors include U.S. Pat. No. 4,846,241; U.S. Pat. No. 4,673,019; U.S. Pat. No. Des. 334,067; U.S. Pat. No. 4,231,412; U.S. Pat. No. 3,146,824; and U.S. Pat. No. 1,843,731.

While these devices fulfill their respective, particular objectives and requirements, the aforementioned patents do not disclose a new automatic garage door screen. The inventive device includes a flexible panel having a plurality of apertures therethrough extending between first and second surfaces of the panel. A storage housing mountable to the top of a garage door opening is also provided. An elongate roller is rotatably mounted in the interior of the storage housing with a motor included for rotating the roller. The top edge of the panel is coupled to the roller. A pair of elongate guide tracks are mountable to the sides of a garage door opening. Each guide track has an elongate side channel extending between the ends of the guide track. One of the side edges of the panel is inserted into the side channel of one of the guide tracks while the other side edge of the panel is inserted into the side channel of the other guide track.

In these respects, the automatic garage door screen according to the present invention substantially departs from the conventional concepts and designs of the prior art, and in so doing provides an apparatus primarily developed for the purpose of covering a garage door opening to let air through while still providing a barrier to insects and debris.

SUMMARY OF THE INVENTION

In view of the foregoing disadvantages inherent in the known types of screen door devices for garage doors now present in the prior art, the present invention provides a new automatic garage door screen construction wherein the same can be utilized for covering a garage door opening to let air through while still providing a barrier to insects and debris.

The general purpose of the present invention, which will be described subsequently in greater detail, is to provide a new automatic garage door screen apparatus and method which has many of the advantages of the screen door devices for garage doors mentioned heretofore and many novel features that result in a new automatic garage door screen which is not anticipated, rendered obvious, suggested, or even implied by any of the prior art screen door devices for garage doors, either alone or in any combination thereof.

To attain this, the present invention generally comprises a flexible panel having a plurality of apertures therethrough extending between first and second surfaces of the panel. A storage housing mountable to the top of a garage door opening is also provided. An elongate roller is rotatably mounted in the interior of the storage housing with a motor included for rotating the roller. The top edge of the panel is coupled to the roller. A pair of elongate guide tracks are mountable to the sides of a garage door opening. Each guide track has an elongate side channel extending between the ends of the guide track. One of the side edges of the panel is inserted into the side channel of one of the guide tracks while the other side edge of the panel is inserted into the side channel of the other guide track.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new automatic garage door screen apparatus and method which has many of the advantages of the screen door devices for garage doors mentioned heretofore and many novel features that result in a new automatic garage door screen which is not anticipated, rendered obvious, suggested, or even implied by any of the prior art screen door devices for garage doors, either alone or in any combination thereof.

It is another object of the present invention to provide a new automatic garage door screen which may be easily and efficiently manufactured and marketed.

It is a further object of the present invention to provide a new automatic garage door screen which is of a durable and reliable construction.

An even further object of the present invention is to provide a new automatic garage door screen which is susceptible of a low cost of manufacture with regard to both materials and labor, and which accordingly is then susceptible of low prices of sale to the consuming public, thereby making such automatic garage door screen economically available to the buying public.

Still yet another object of the present invention is to provide a new automatic garage door screen which provides in the apparatuses and methods of the prior art some of the advantages thereof, while simultaneously overcoming some of the disadvantages normally associated therewith.

Still another object of the present invention is to provide a new automatic garage door screen for covering a garage door opening to let air through while still providing a barrier to insects and debris.

Yet another object of the present invention is to provide a new automatic garage door screen which includes a flexible panel having a plurality of apertures therethrough extending between first and second surfaces of the panel. A storage housing mountable to the top of a garage door opening is also provided. An elongate roller is rotatably mounted in the interior of the storage housing with a motor included for rotating the roller. The top edge of the panel is coupled to the roller. A pair of elongate guide tracks are mountable to the sides of a garage door opening. Each guide track has an elongate side channel extending between the ends of the guide track. One of the side edges of the panel is inserted into the side channel of one of the guide tracks while the other side edge of the panel is inserted into the side channel of the other guide track.

Still yet another object of the present invention is to provide a new automatic garage door screen that provides a sun screen to a garage door opening so that a user may see out of the garage without letting excessive sunlight in.

Even still another object of the present invention is to provide a new automatic garage door screen that has a retracting device so that is may be opened remotely.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a schematic front side view of a new automatic garage door screen in use covering a garage door opening according to the present invention.

FIG. 2 is a schematic side view of the top region of the present invention mounted to the top of a garage door opening.

DESCRIPTION OF THE PREFERRED EMBODIMENT

Figure 3:
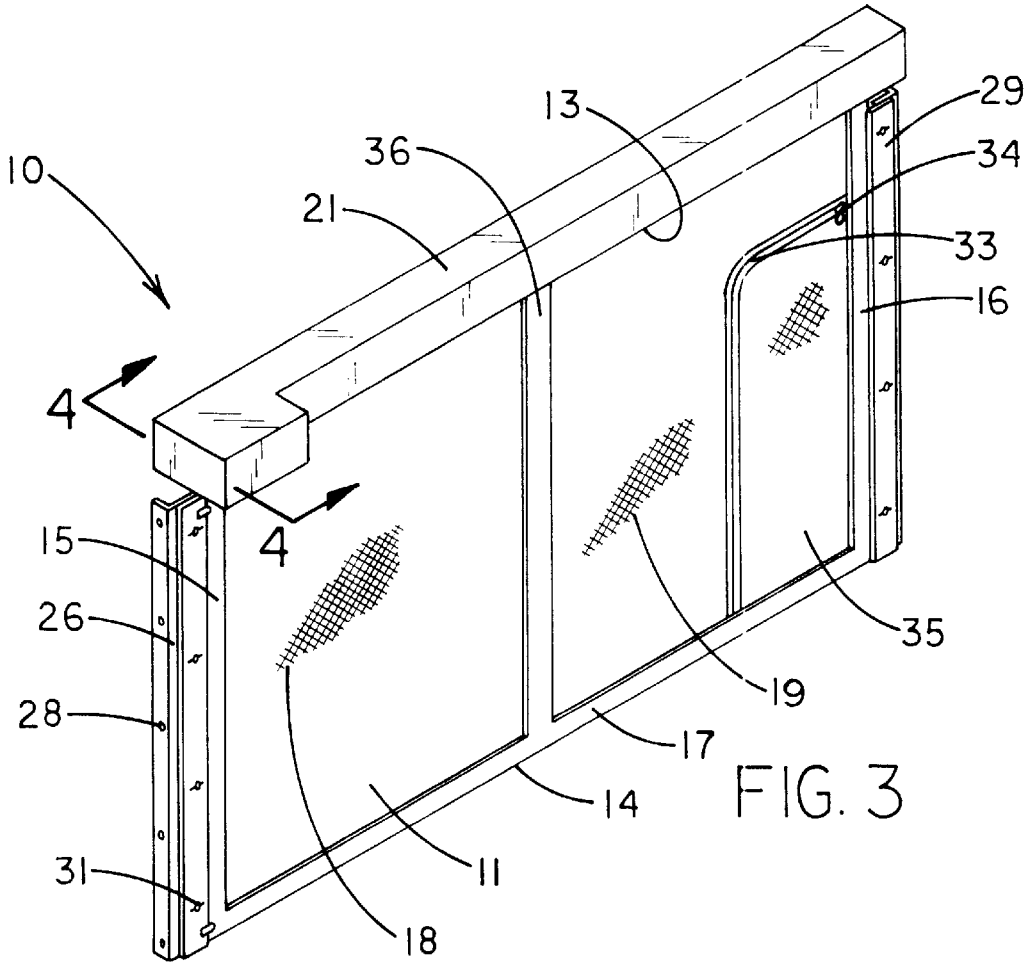
FIG. 3 is a schematic perspective view of the present invention.

With reference now to the drawings, and in particular to FIGS. 1 through 7 thereof, a new automatic garage door screen embodying the principles and concepts of the present invention and generally designated by the reference numeral 10 will be described.

As best illustrated in FIGS. 1 through 7, the automatic garage door screen 10 generally comprises a flexible panel 35 having a plurality of apertures therethrough extending between first and second surfaces 11,12 of the panel 35. A storage housing 21 mountable to the top of a garage door opening is also provided. An elongate roller 23 is rotatably mounted in the interior of the storage housing 21 with a motor 24 included for rotating the roller 23. The top edge 13 of the panel 35 is coupled to the roller 23. A pair of elongate guide tracks 26,27 are mountable to the sides of a garage door opening. Each guide track has an elongate side channel 32 extending between the ends of the guide track. One of the side edges 15 of the panel is inserted into the side channel 32 of one of the guide tracks 26 while the other side edge of the panel is inserted into the side channel of the other guide track.

In use, the screen device 10 is designed for mounting to a garage door opening having a top, a bottom and a pair of sides. In closer detail, the flexible panel 35 is generally rectangular and has first and second surfaces 11,12, top and bottom edges 13,14, and a air of sides edges 15,16 extending between the top and bottom edges 13,14 of the panel 35. The panel 35 has a plurality of apertures therethrough extending between the first and second surfaces 11,12 of the panel 35. Preferably, the panel 35 comprises a mesh screen. In an ideal embodiment, the panel 35 has a frame 17 comprising a flexible plastic extending around the outer perimeter of the panel 35. The frame 17 also preferably includes an elongate cross member 36 extending between the top and bottom edges 13,14 of the panel 35 to divide the mesh screen into two separate rectangular sections 18,19. In the preferred embodiment, the bottom edge 14 of the panel 35 is weighted to help keep the bottom of the panel 35 positioned towards the bottom of the garage door opening and to help resist blowing of the bottom edge 14 of the panel 35 by wind. Each of the side edges 15,16 of the panel 35 has an elongate bead 20 extending along its length between the top and bottom edges 13,14 of the panel 35. Ideally, the bead 20 has a generally circular cross section.

Figure 4:
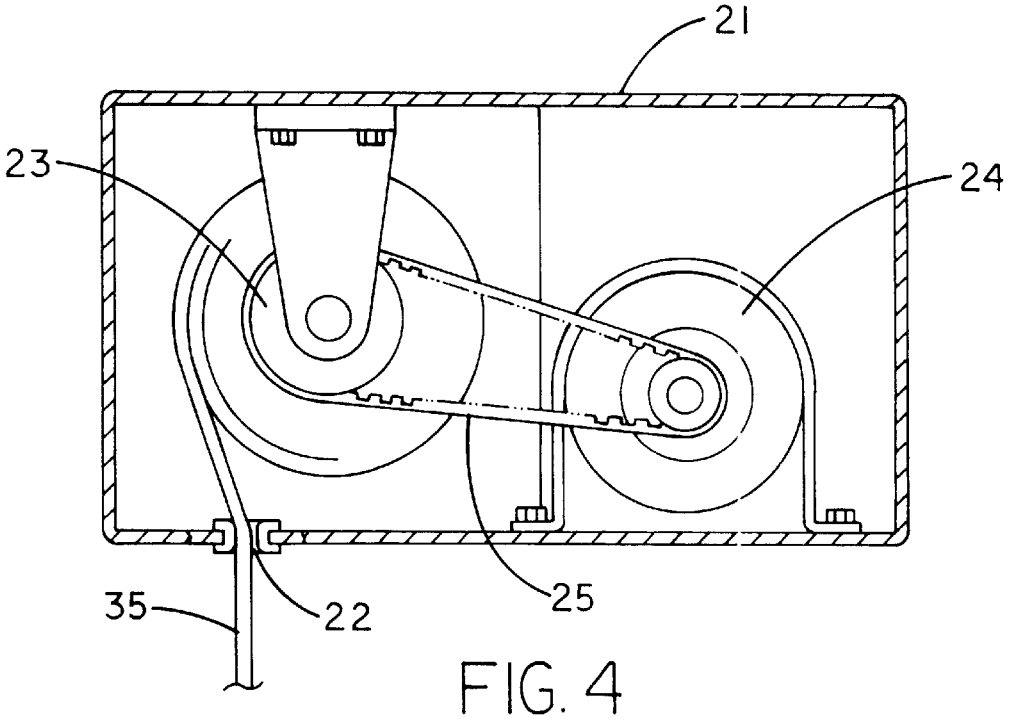
FIG. 4 is a schematic cross sectional view of the storage housing of the present invention taken from line 4—4 on FIG. 3.

The screen device also includes a elongate storage housing 21. With reference to FIG. 4, the storage housing 21 has an interior and an elongate opening 22 into the interior of the housing 21. As illustrated in FIGS. 1, 2, and 3, the storage housing 21 is mountable to the top of a garage door opening such that opening 22 of the storage housing 21 extends between the sides of the garage door opening. An elongate roller 23 is rotatably mounted in the interior of the storage housing 21 such that the roller 23 extends between the sides of the garage door opening. A motor 24 is provided for selectively rotating the roller 23 in both a clockwise and counter-clockwise direction. The motor 24 is preferably provided in the interior of the storage housing 21. Ideally, the motor 24 is operatively connected to the roller 23 by a drive belt 25 looped around the rotating shaft of the motor 24 and an end pulley of the roller 23. Rotation of the motor 24 is preferably controllable by a switch in the garage or by a remote controller such as an automatic garage door opener remote controller.

As illustrated in FIG. 4, the top edge 13 of the panel 35 is coupled to the roller 23 with the width of the panel 35 between the side edges 15,16 of the panel 35 extends along the length of the roller 23 so that the panel 35 is suspendable from the top of a garage door opening. Ideally, rotation of the roller 23 in a first direction rolls the panel 35 around the roller 23 to retract the panel 35 inside the interior of the storage housing 21. Conversely, rotation of the roller 23 in a second direction opposite to the first direction unwraps the panel 35 from around the roller 23 so that the panel 35 may be extended to cover the garage door opening.

Figure 5:
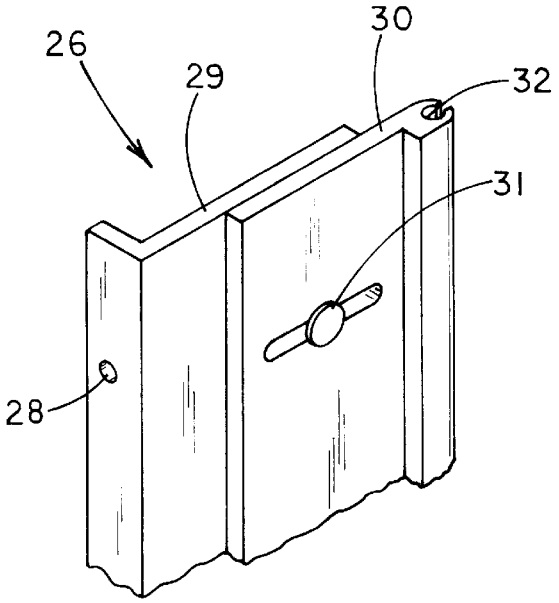
FIG. 5 is a schematic partial perspective view of a guide track of the present invention.
Figure 6:
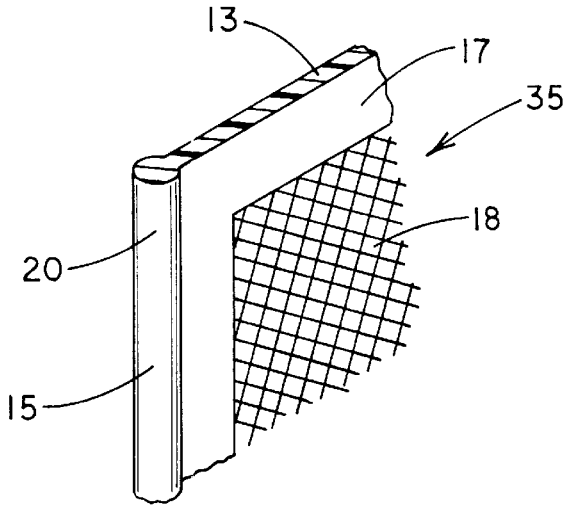
FIG. 6 is a schematic partial perspective view of one of the side edges of the panel of the present invention.
Figure 7:
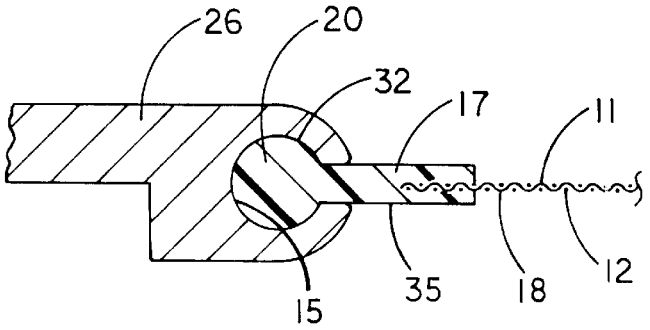
FIG. 7 is a schematic sectional view of the bead of a side edge of the panel inserted into the channel of a guide track of the present invention.

With reference to FIGS. 3, 5, and 7, the device 10 also includes a pair of elongate adjustable guide tracks 26,27. Each guide track has a pair of opposite ends and a length extending between the ends of the guide track. Each of the guide tracks 26,27 is mountable to a side of a garage door opening such that the length of the guide track extends between the top and bottom of the garage door opening. Ideally, the guide tracks 26,27 are attached to the sides of a garage door opening by extending fasteners through a plurality of mounting holes 28 along the length of each of the guide tracks 26,27. Preferably, each guide track comprising a pair of separable elongate portions 29,30 which are adjustably fastened 31 together so that the width and the plumb of the guide tracks 26,27 may be adjusted. Each guide track has an elongate side channel 32 extending along the length of the guide track between the ends of the guide track. The side channels 32 of the guide tracks 26,27 facing one another when the guide tracks 26,27 are mounted on opposite sides of a garage door opening such that the upper ends of the side channels 32 are positioned adjacent the opening 22 of the storage housing 21. As illustrated in FIG. 6, the bead of one of the side edges of the panel is slidably inserted into the side channel of one of the guide tracks while the bead of another of the side edges of the panel is similarly slidably inserted into the side channel of the other guide track such that the side channels help position the side edges 15,16 of the panel 35 along the sides of the garage door opening and help guide the side edges 15,16 of the panel 35 into and out of the interior of the storage housing 21.

Preferably, the panel 35 has an generally inverted L-shaped slit 33 therethrough between the surfaces of the panel 35. The slit 33 defines a door flap for providing an opening 22 through the panel 35 for permitting passage of a person therethrough. One of the ends of the slit 33 is positioned adjacent one of the side edges 16 of the panel 35 while the other end of the slit 33 is positioned adjacent the bottom edge 14 of the panel 35. Ideally, the panel 35 has a zipper 34 for selectively closing the slit 33.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling, within the scope of the invention.

I claim:

1. A screen device for a garage door opening having a top, a bottom and a pair of sides, said screen device comprising:

a flexible panel having first and second surfaces, top and bottom edges, and a pair of sides edges extending between said top and bottom edges of said panel, said panel having a plurality of apertures there through extending between said first and second surfaces of said panel;

a storage housing having an interior and an elongate opening into said interior of said housing, said storage housing being mountable to the top of a garage door opening;

an elongate roller being rotatably mounted in said interior of said storage housing;

a motor for rotating said roller;

said top edge of said panel being coupled to said roller;

a pair of elongate guide tracks, each guide track having a pair of opposite ends and a length extending between the ends of said guide track, each of said guide tracks being mountable to a side of a garage door opening;

each guide track having an elongate side channel extending between said ends of said guide track;

one of said side edges of said panel being inserted into said side channel of one of said guide tracks, another of said side edges of said panel being inserted into said side channel of another of said guide tracks; and said panel having a generally L-shaped slit therethrough between said surfaces of said panel, said slit defining a flap for providing an opening through said panel, said slit having a pair of ends, one of said ends of said slit being positioned adjacent one of said side edges of said panel, another of said ends of said slit being positioned adjacent said bottom edge of said panel.

2. The screen device of claim 1, wherein said panel comprises a mesh screen.

3. The screen device of claim 1, wherein each of said side edges of said panel has an elongate bead extending therealong between said top and bottom edges of said panel, wherein said bead of one of said side edges of said panel is inserted into said side channel of one of said guide tracks, and wherein said bead of another of said side edges of said panel is inserted into said side channel of another of said guide tracks.

4. The screen device of claim 1, wherein said motor is provided in said interior of said storage housing.

5. The screen device of claim 1, wherein rotation of said roller in a first direction rolls said panel around said roller, wherein rotation of said roller in a second direction unwraps said panel from around said roller.

6. The screen device of claim 1, wherein said panel has a zipper for selectively closing said slit.

7. The screen device of claim 1, wherein said slit has a horizontal elongate upper portion and a vertical elongate lower portion extending substantially perpendicular to said upper portion of said slit, wherein said upper portion of said slit extends between said lower portion of said slit and said one side edge of said panel, wherein said lower portion of said slit extends between said upper portion of said slit and said bottom edge of said panel, wherein upper portion of said slit is extended substantially perpendicular to said one side edge of said panel and substantially parallel to said bottom edge of said panel, and wherein said lower portion of said slit is extended substantially perpendicular to said bottom edge of said panel and substantially parallel to said side edges of said panel.

8. The screen device of claim 7, wherein said upper portion of said slit has a length defined between said lower portion of said slit and said one side edge of said panel, wherein said lower portion of said slit has a length defined between said upper portion of said slit and said bottom edge of said panel, and wherein said length of said lower portion of said slit is greater than said length of said upper portion of said slit.

9. The screen device of claim 7, wherein said upper portion of said slit is located in an upper half portion of said panel located adjacent said top edge of said panel.

10. The screen device of claim 7, wherein said panel has a height defined between said top and bottom edges of said panel, wherein said upper portion of said slit is positioned towards said top edge of said panel such that said upper portion of said slit is spaced apart from said top edge of said panel less than about one-fourth of said height of said panel.

11. A screen device for a garage door opening having a top, a bottom and a pair of sides, said screen device comprising:

a flexible panel being generally rectangular and having first and second surfaces, top and bottom edges, and a pair of sides edges extending between said top and bottom edges of said panel, said panel having a plurality of apertures therethrough extending between said first and second surfaces of said panel, wherein said panel comprises a mesh screen;

each of said side edges of said panel having an elongate bead extending therealong between said top and bottom edges of said panel;

a storage housing having an interior and an elongate opening into said interior of said housing, said storage housing being mountable to the top of a garage door opening such that opening of said storage housing extends between the sides of the garage door opening;

an elongate roller being rotatably mounted in said interior of said storage housing;

a motor for rotating said roller, said motor being provided in said interior of said storage housing;

said top edge of said panel being coupled to said roller such that said panel is suspendable from the top of a garage door opening so that said panel may substantially cover the garage door open, wherein rotation of said roller in a first direction rolls said panel around said roller, wherein rotation of said roller in a second direction unwraps said panel from around said roller;

a pair of elongate guide tracks, each guide track having a pair of opposite ends and a length extending between the ends of said guide track, each of said guide tracks being mountable to a side of a garage door opening such that the length of the guide track extends between the top and bottom of the garage door opening, one of said guide tracks being mountable to one side of the garage door opening, another of said guide tracks being mountable to another side of the garage door opening;

each guide track having an elongate side channel extending between said ends of said guide track, said side channels of said guide tracks facing one another when said guide tracks are mounted on opposite sides of a garage door opening;

said bead of one of said side edges of said panel being inserted into said side channel of one of said guide tracks, said bead of another of said side edges of said panel being inserted into said side channel of another of said guide tracks;

said panel having a generally L-shaped slit therethrough between said surfaces of said panel, said slit defining a flap for providing an opening through said panel, said slit having a pair of ends, one of said ends of said slit being positioned adjacent one of said side edges of said panel, another of said ends of said slit is positioned adjacent said bottom edge of said panel; and said panel having a zipper for selectively closing said slit.

* * * * *